US005325939A

United States Patent [19]

Schwendt

[11] Patent Number: 5,325,939

[45] Date of Patent: Jul. 5, 1994

[54] DRIVE UNIT FOR VEHICLES DRIVEN ON RAILS

[75] Inventor: Lutz Schwendt, Vellmar, Fed. Rep. of Germany

[73] Assignee: ABB Patent GmbH, Mannheim, Fed. Rep. of Germany

[21] Appl. No.: 975,665

[22] Filed: Nov. 13, 1992

[30] Foreign Application Priority Data

Nov. 13, 1991 [DE] Fed. Rep. of Germany ..... 4137234

[51] Int. Cl.[5] ..... B61C 9/44; B61H 5/00

[52] U.S. Cl. ..... 188/33; 188/58; 464/85

[58] Field of Search ..... 188/33, 34, 58; 464/85, 464/92, 93, 87, 94, 95, 179, 183

[56] References Cited

U.S. PATENT DOCUMENTS

| | | | |
|---|---|---|---|
| 1,606,753 | 11/1926 | Eaton | 188/33 |
| 2,017,666 | 10/1935 | Baughman | 188/33 X |
| 2,855,073 | 10/1958 | Walker | 188/33 |
| 2,869,339 | 1/1959 | Drake | 464/85 |
| 2,903,097 | 9/1959 | Busch | 188/33 X |
| 3,034,599 | 5/1962 | Gaenssle | 188/33 X |
| 3,626,862 | 12/1971 | Korn | 188/33 X |
| 4,214,458 | 7/1980 | Philleo | 464/85 |
| 4,671,780 | 6/1987 | Weir | 464/85 |
| 4,674,410 | 6/1987 | Santanera et al. | 464/92 X |

FOREIGN PATENT DOCUMENTS

| | | |
|---|---|---|
| 0007021 | 1/1980 | European Pat. Off. . |
| 2027019 | 9/1970 | France . |

*Primary Examiner*—Robert J. Oberleitner
*Assistant Examiner*—Peter M. Poon
*Attorney, Agent, or Firm*—Herbert K. Lerner; Laurence A. Greenberg

[57] ABSTRACT

A drive unit for vehicles driven on rails includes an electric drive motor. A transmission which is driven by the drive motor has a main transmission hollow drive shaft. A hollow coupling shaft supports brake surfaces. One flexible rubber coupling is connected between the hollow drive shaft and one end of the hollow coupling shaft, and another flexible rubber coupling is connected between a wheel of a wheel set and another end of the hollow coupling shaft.

5 Claims, 1 Drawing Sheet

DRIVE UNIT FOR VEHICLES DRIVEN ON RAILS

Figure 1:
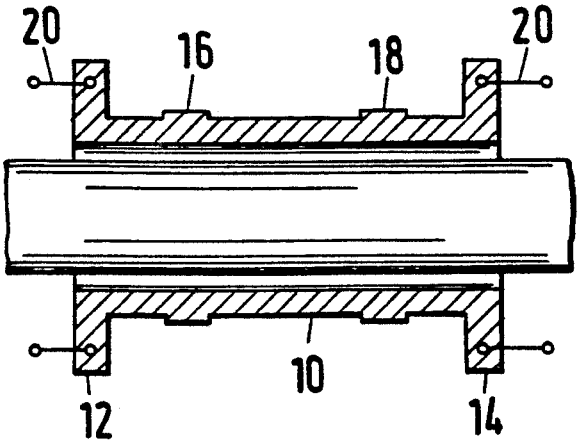

The invention relates to a drive unit for vehicles driven on rails, having an electric drive motor, a transmission and a main transmission shaft constructed as a hollow shaft, which acts on a wheel set through a flexible rubber coupling.

It is known in connection with driven wheel sets of vehicles that are driven on rails, that for reasons of space, braking devices, mainly disk brakes, are disposed, if at all, only on the wheel set itself which is unsprung or has no springs, and namely on its wheel shaft. Extensive structures which are required therefor need to compensate for the spring travel with reduction of the brake output, if the structures are connected with the pivoted bogie or truck receiving the wheel set. In connection therewith, the mass of the vehicle which is unsprung or has no springs, increased by the brake devices, is generally of considerable disadvantage.

It is accordingly an object of the invention to provide a drive unit for vehicles driven on rails, which overcomes the hereinafore-mentioned disadvantages of the heretofore-known devices of this general type, which has a construction that is assembly and service-friendly and which permits the reduction of the mass which is unsprung or has no springs.

With the foregoing and other objects in view there is provided, in accordance with the invention, a drive unit for vehicles driven on rails, comprising an electric drive motor, a transmission being driven by the drive motor, the transmission having a main transmission hollow drive shaft, a hollow coupling shaft having ends, brake surfaces supported on the hollow coupling shaft, a wheel set having wheels, one flexible rubber coupling connected between the hollow drive shaft and one of the ends of the hollow coupling shaft, and another flexible rubber coupling connected between one of the wheels and another of the ends of the hollow coupling shaft.

It is therefore possible through the use of the structure according to the invention, to do without brake disks directly disposed on the wheel shafts and instead to place them on the hollow coupling shaft which surrounds the wheel shaft concentrically. The mass which is unsprung or has no springs, is reduced in this way.

In accordance with another feature of the invention, there are provided brake surfaces disposed on the surface area of the periphery of the hollow coupling shaft. Depending on their radial extension, these brake surfaces can be acted upon by brake devices which are provided either azimuthally, i.e. in the circumferential direction, or axially.

The essential advantage of the structure according to the invention lies in the fact that it is not necessary to dismantle the transmission for replacing worn brake surfaces. Instead, only a replacement of the hollow coupling shaft is needed.

In accordance with a further feature of the invention, the brake surfaces are circumferential radial elements formed on the hollow coupling shaft.

In accordance with an added feature of the invention, the radial elements formed on the hollow coupling shaft are brake disks.

In accordance with an additional feature of the invention, the brake surfaces are exchangeable brake disks disposed on the hollow coupling shaft.

Other features which are considered as characteristic for the invention are set forth in the appended claims.

Although the invention is illustrated and described herein as embodied in a drive unit for vehicles driven on rails, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
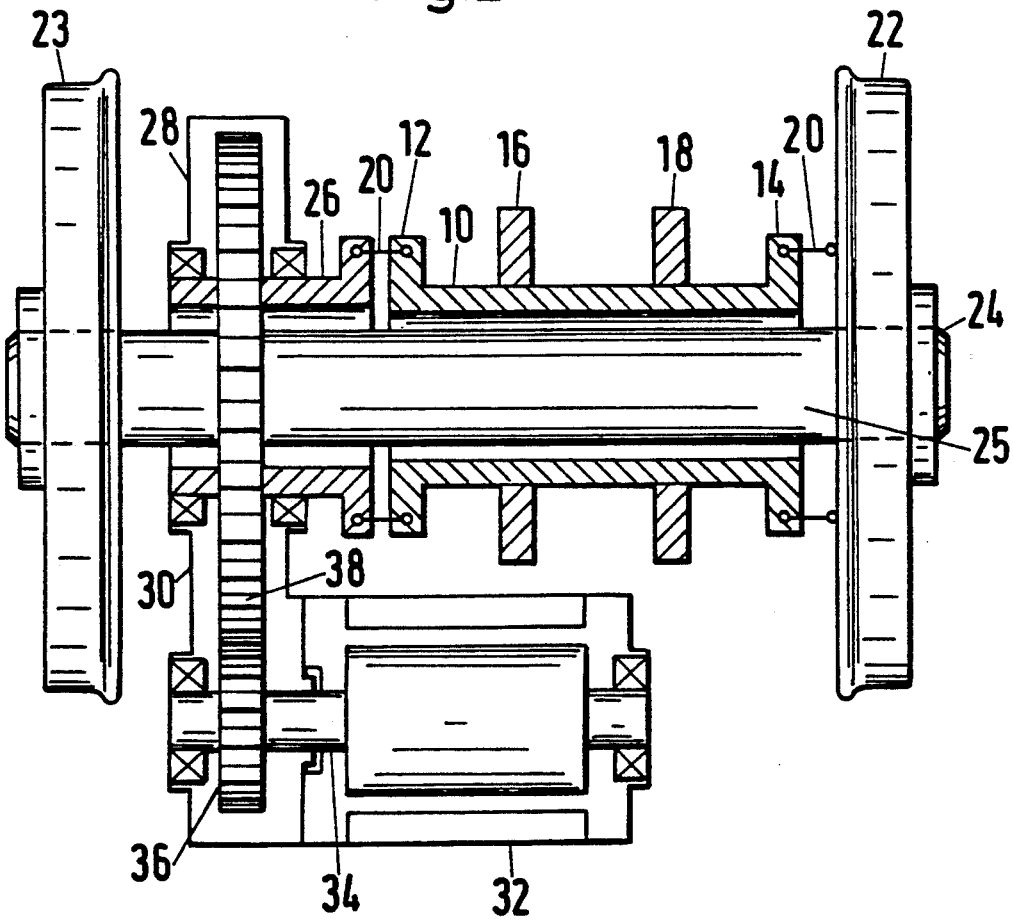

FIG. 1 is a fragmentary, diagrammatic, partly sectional, elevational view of a hollow coupling shaft in accordance with the invention; and FIG. 2 is an elevational view of a hollow coupling shaft combined with a drive unit and a wheel set.

Referring now to the figures of the drawing in detail and first, particularly, to FIG. 1 thereof, there is seen a hollow coupling shaft 10 which is constructed as a circular-cylindrical body and has respective annular flanges 12, 14 on each of its ends. Circumferential radial elements 16, 18 which are formed on the outer surface area of the cylindrical hollow coupling shaft 10, are spaced apart from each other and from the annular flanges 12, 14, and are used as brake surfaces. These brake surfaces 16, 18, that are connected in one piece with the hollow coupling shaft 10, cooperate with non-illustrated brake devices, which act on the brake surfaces 16, 18 either radially, axially or azimuthally, in accordance with their structure.

With an appropriate radial extent of the brake surfaces 16, 18, as is shown by way of example in FIG. 2, an axial action by the non-illustrated brake devices takes place in such a way that the brake surfaces 16, 18 are used as brake disks. The brake disks may be exchangeable, as is indicated by the different section hatching in elements 16, 18 and element 10.

Radial action occurs with the use of brake shoes, and azimuthal action with the use of band brakes.

The annular flanges 12, 14 that are disposed on the ends of the hollow coupling or drive shaft 10, are provided with evenly disposed screw holes that are used for attaching a flexible rubber coupling 20, which is only diagrammatically illustrated.

As is shown in FIG. 2, one end of the hollow coupling shaft 10 is connected with a wheel 22 of a wheel set 24, which includes a further wheel 23 and a wheel shaft 25 interconnecting these two wheels 22, 23.

The wheel shaft 25 extends without contact through the hollow coupling shaft 10 and a main transmission shaft in the form of a hollow drive shaft 26 of a transmission 28, that is also frictionally connected with the coupling 20.

An electric drive motor 32 is housed along with the transmission 28 in a common housing 30. The drive motor 32, which has a structure that is only diagrammatically illustrated, has a rotor shaft 34 on which a pinion gear 36 is fixed for driving a drive wheel 38. The drive wheel 38 acts through the hollow drive shaft 26 and the flexible rubber coupling 20 on the hollow coupling shaft 10, which in turn drives the wheel 22 of the wheel set 24 through the flexible rubber coupling 20.

As is indicated by the illustration in FIG. 2, the wheels 22, 23 of the wheel set 24 are removably disposed on the wheel shaft 25, so that in case repairs become necessary or in case of an exchange of the hollow coupling shaft 10, only the wheel 22 located on one side needs to be removed from the wheel shaft 25, and the hollow coupling shaft 10 can be taken off after removal of the flexible rubber coupling 20.

Due to this construction, a clear improvement can be seen in regard to the required time and necessary costs in comparison with the customary constructions.

I claim:

1. A drive unit for vehicles driven on rails, comprising an electric drive motor, a transmission being driven by said drive motor, said transmission having a main transmission hollow drive shaft, a hollow coupling shaft having ends, brake surfaces integrally supported on said hollow coupling shaft, a wheel set having wheels, one flexible rubber coupling connected between said hollow drive shaft and one of said ends of said hollow coupling shaft, and another flexible rubber coupling connected between one of said wheels and another of said ends of said hollow coupling shaft.

2. The drive unit according to claim 1, wherein said brake surfaces are circumferential radial elements integrally formed on said hollow coupling shaft.

3. The drive unit according to claim 2, wherein said radial elements formed on said hollow coupling shaft are brake disks.

4. The drive unit according to claim 1, wherein said brake surfaces are exchangeable brake disks disposed on said hollow coupling shaft.

5. A drive unit for vehicles driven on rails, comprising an electric drive motor, a transmission being driven by said drive motor, said transmission having a main transmission hollow drive shaft, a hollow coupling shaft having ends, brake surfaces in the form of brake disks disposed on said hollow coupling shaft, a wheel set having wheels, one flexible rubber coupling connected between said hollow drive shaft and one of said ends of said hollow coupling shaft, and another flexible rubber coupling connected between one of said wheels and another of said ends of said hollow coupling shaft.

* * * * *